United States Patent [19]

Loew

[11] 4,157,606

[45] Jun. 12, 1979

[54] YARN TANGLING DEVICE

[75] Inventor: Harold F. Loew, Asheville, N.C.

[73] Assignee: Akzona Incorporated, Asheville, N.C.

[21] Appl. No.: 831,990

[22] Filed: Sep. 9, 1977

[51] Int. Cl.[2] ..... D02G 1/16

[52] U.S. Cl. ..... 28/271; 28/273

[58] Field of Search ..... 28/254, 271, 272, 273, 28/274, 275, 276; 57/157 F; 226/7, 97; 302/25, 63; 239/433

[56] References Cited

U.S. PATENT DOCUMENTS

| | | | |
|---|---|---|---|
| 1,562,194 | 11/1925 | Schaefer | 239/433 X |
| 3,005,251 | 10/1961 | Hallden et al. | 28/273 X |
| 3,282,768 | 11/1966 | Caines et al. | 28/271 X |
| 3,730,413 | 5/1973 | McDermott et al. | 28/272 |
| 3,805,343 | 4/1974 | Ethridge | 28/273 |

FOREIGN PATENT DOCUMENTS

| | | | |
|---|---|---|---|
| 2413718 | 10/1974 | Fed. Rep. of Germany | 28/271 |
| 46-7228 | 2/1971 | Japan | 28/273 |

*Primary Examiner*—Louis Rimrodt

*Attorney, Agent, or Firm*—Craig and Antonelli

[57] ABSTRACT

A yarn tangler arrangement for all types of filament yarns which includes two individual members which are adapted to be threadably coupled together. Each of the members include a longitudinally extending bore which terminates in respective chamfered portions which define a yarn processing chamber. An air supply bore is arranged in one of the members at a predetermined angle with respect to a terminal edge of one of the chamfered portions with the supply bore feeding compressed air into the chamber so as to aspirate yarn from one longitudinal bore accommodating the yarn to be processed with the processed yarn then being directed from the chamber to the other longitudinally extending bore which accommodates the processed yarn.

19 Claims, 1 Drawing Figure

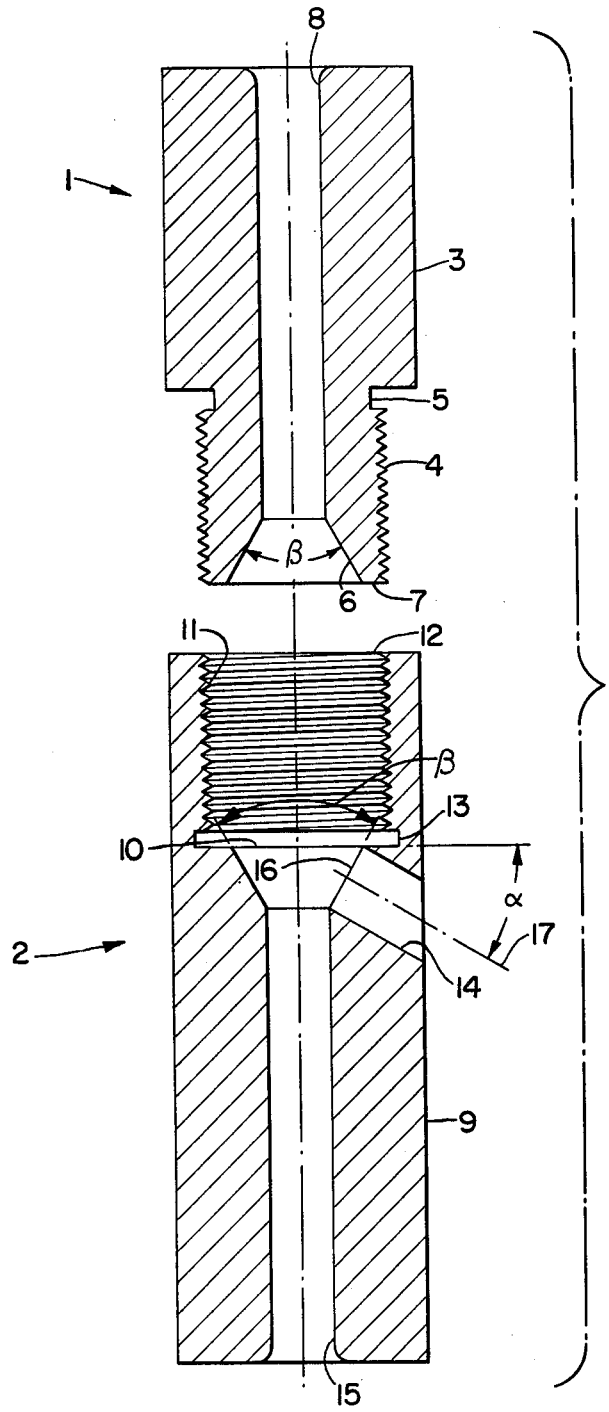
8
1
3
5
4
β
6
7
11
12
β
13
10
16
α
17
2
14
9
15

YARN TANGLING DEVICE

The present invention relates to a yarn processing arrangement and, more particularly, to a yarn texturing or tangling device for multifilament yarns.

Devices for texturing or tangling multifilament yarn have been proposed, for example, in U.S. Pat. Nos. 3,026,597; 3,484,914; and 3,389,444, wherein the multifilament yarn is continuously fed through a texturing jet or nozzle with pressurized air being directed at the yarn so as to individually tangle the fibers thereof.

One disadvantage of the proposed devices resides in the fact that the texturing jet or nozzle is constructed as a one-piece element so that it is not possible to obtain a short length for a yarn hole surface finish.

A further disadvantage of the proposed devices resides in the fact that, by virtue of the constructional features thereof, the multifilament yarn is not aspirated into the texturing jet or nozzle.

The aim underlying the present invention essentially resides in improving a yarn texturing or tangling device of the above-mentioned type. For this purpose, according to one advantageous feature of the present invention, a yarn tangler device is provided which is of a bipartite construction. By virtue of such construction it is possible to achieve a shorter length for the yarn hole surface finish than in conventional constructions.

According to another advantageous feature of the present invention, each piece of the bipartite tangler device is constructed with a chamfered entrance in the yarn hole which communicates with an air inlet hole so as to provide an aspirator to aspirate the yarn into the tangler device.

According to yet another feature of the present invention, the air inlet hole, provided in one of the pieces of the tangler device subtends with an upper surface of an associated chamfered entrance portion at an angle of preferably 22.5°.

According to a further feature of the present invention, one piece of the tangler device is provided with a threaded male coupling element adapted to be received by a corresponding female threaded coupling element with the forward end of the male coupling element and a mating surface provided at a bottom end of the female coupling element forming sealing surfaces so as to prevent the supplied air in the tangling device from escaping through the coupling elements.

Accordingly, it is an object of the present invention to provide a yarn tangler arrangement for multifilament yarns which avoids by simple means the drawbacks and shortcomings encountered in the prior art.

Another object of the present invention resides in providing a yarn tangler arrangement for multifilament yarns which is simple in construction and therefore relatively inexpensive to manufacture.

Still another object of the present invention resides in providing a yarn tangler arrangement for multifilament yarns which can readily be installed and removed from a yarn processing apparatus without any difficulties.

A further object of the present invention resides in providing a yarn tangler arrangement for multifilament yarns which functions reliably under all operating conditions.

A still further object of the present invention resides in providing a yarn tangler arrangement which assures an aspiration of the yarn therein.

Yet another object of the present invention resides in providing a yarn tangler arrangement for multifilament yarns by which it is possible to obtain a short length for a yarn hole surface finish.

These and other objects, features, and advantages of the present invention will become more apparent from the following description when taken in connection with the accompanying drawing which shows, for the purpose of illustration only, one embodiment in accordance with the present invention, and wherein:

The single FIGURE is an exploded longitudinal cross-sectional view of a yarn tangler arrangement in accordance with the present invention.

Referring now to the single FIGURE of the drawing, according to this FIGURE, the yarn tangler arrangement includes a first member generally designated by the reference numeral 1 and a second member generally designated by the reference numeral 2 with the first and second members being adapted to be threadably secured to each other.

The first member 1 includes a body portion 3 and a coupling portion 4 terminating in a sealing surface 7. The coupling portion 4 is provided with a threading extending from the sealing surface 7 to a thread relief portion 5. A yarn receiving bore 8 extends centrally through the body portion 3 and coupling portion 4 and terminates in a chamfered portion 6 which has a predetermined angle $\beta$ which is preferably equal to 45°.

The second member 2 includes a body portion 9 having arranged at one end thereof a female coupling portion 11 for accommodating the coupling portion 4. The female coupling portion 11 is provided with a threading corresponding to the threading of the coupling portion 4. The threading of the coupling portion 11 extends from the end surface 12 of the second member to a thread relief portion 13.

A yarn receiving bore 15 extends centrally through the body portion 9 and terminates in a chamfered portion 16 which has a predetermined angle $\beta$ which is preferably equal to 45°. An air inlet bore 14 is provided in the body portion 9 with a center line 17 of the bore 10 subtending with a line extending through the surface 10, defined at the upper edge of the chamfered portion 16, a predetermined angle $\alpha$ which is preferably equal to 22.5°.

In use, members 1 and 2 are threadably coupled so as to bring the surfaces 7 and 10 into a mating relationship. In order to insure a proper sealing of the surfaces 7 and 10, both of these surfaces are highly polished, thereby precluding any leakage of air at the surfaces 7, 10.

After the members 1, 2 are coupled and arranged in a yarn processing apparatus, compressed air is delivered from a compressed air source (not shown) to the air inlet bore 14 with the compressed air being fed into the chamber defined by the chamfered portions 6, 16 so as to aspirate a multifilament yarn through the bore 15 into the chamber thereby tangling the individual fibers of the yarn.

A suitable conventional take-off device (not shown) is arranged upstream of the bore 8, as viewed in the direction of movement of the yarn, so as to draw the processed tangled yarn from the chamber defined by the chamfered portions 6, 16 through the bore 8 and direct the same to further processing elements in the yarn processing apparatus.

While I have shown and described only one embodiment in accordance with the present invention, it is understood that the same is not limited thereto but is susceptible of numerous changes and modifications as known to one skilled in the art and I therefore do not wish to be limited to the details shown and described herein but intend to cover all such modifications as are encompassed by the scope of the appended claims.

I claim:

1. A yarn tangler arrangement for processing multifilament yarn, the arrangement comprising the first member having a body portion and a coupling portion, a longitudinally extending bore means extending through said body portion and said coupling portion for accommodating a length of processed yarn, a chamfered portion provided at an end of said bore means arranged in the coupling portion, a second member having a body portion and a coupling portion, said coupling portion of said second member being configured so as to cooperate with said coupling portion of said first member thereby fixedly coupling said first and second members, a further longitudinally extending bore means arranged in said second member for accommodating a length of yarn to be processed, said further bore means terminating in a chamfered portion, said chamfered portions of said bore means and said further bore means defining a chamber for accommodating yarn when said first and second members are fixedly coupled, and an air inlet supply means provided in one of said first and second members for supplying a quantity of compressed air to the chamber so as to aspirate yarn into the yarn tangler arrangement.

2. An arrangement according to claim 1, wherein said air inlet means is a supply bore, and wherein a center line of said supply bore subtends a predetermined angle with a terminal edge of a chamfered surface portion in which the air inlet means is provided.

3. An arrangement according to claim 2, wherein said predetermined angle is equal to 22.5°.

4. An arrangement according to claim 3, wherein the chamfered portions of said first and second members each subtend an angle of 45°.

5. An arrangement according to claim 4, wherein said supply bore is arranged in said second member.

6. An arrangement according to claim 5, wherein said coupling portions of one of said first and second members is a threaded male coupling element and the coupling portion of the other of said first and second members is a threaded female coupling element.

7. An arrangement according to claim 6, wherein said threaded male coupling element is provided in said first member.

8. An arrangement according to claim 7, wherein said chamfered portion of said further longitudinally extending bore means terminates at a lower end of said female coupling element.

9. An arrangement according to claim 1, wherein the chamfered portions of said first and second members each subtend an angle of 45°.

10. An arrangement acoording to claim 1, wherein said coupling portions of one of said first and second members is a threaded male coupling element and the coupling portion of the other of said first and second members is a threaded female coupling element.

11. An arrangement according to claim 1, wherein said first member is further provided with a sealing surface surrounding said chamfered portion and said second member is also provided with a further sealing surface surrounding said chamfered portion of said further bore means, said sealing surfaces of said first and second members being brought together in mating relationship when said first and second members are fixedly coupled in contact with each other and the mating relationship of said sealing surfaces providing a seal precluding any leakage of air between said surfaces.

12. An arrangement according to claim 11, wherein said coupling portion of said first member is a threaded male coupling element and the coupling portion of said second member is a threaded female coupling element, the sealing surface surrounding the chamfered portion of said bore means of said first member being provided at the end of said threaded male coupling element and the further sealing surface surrounding the chamfered portion of said further bore means of said second member being located at the bottom end of the female coupling element within a thread relief portion.

13. An arrangement according to claim 1, wherein the arrangement consists of said first member and said second member.

14. An arrangement according to claim 1, wherein the chamfered portions of said first and second members diverge outwardly from said bore means to provide a chamber having a cross-sectional area greater than the cross-sectional area of said bore means.

15. An arrangement according to claim 1, wherein said first and second members are coupled together in contact with each other.

16. A yarn tangling device for processing multifilament yarn, which comprises a first member having a body portion and a threaded coupling portion, a longitudinally extending bore means extending through said body portion and said threaded coupling portion for accommodating a length of processed yarn, a chamfered enlarged portion provided at one end of said bore means arranged in the threaded coupling portion and a sealing surface surrounding said chamfered portion, a second member having a body portion and a threaded coupling portion, said threaded coupling portion of said second member being configured so as to threadably engage the threaded coupling portion of said first member thereby fixedly securing said first and second members together, a further longitudinally extending bore means arranged in said second member for accommodating a length of yarn to be processed, said further bore means terminating in a chamfered enlarged portion and a further sealing surface surrounding said chamfered portion of said further bore means, said chamfered portions of said bore means and said further bore means defining a chamber for accommodating yarn when said first and second members are secured together and said sealing surfaces of said first and second members are brought together in mating relationship, and an air inlet supply means provided in one of said first and second members for applying a quantity of compressed air to the chamber to aspirate yarn into the yarn tangler device, the mating relationship of said sealing surfaces providing a seal that precludes any leakage of air between said surfaces.

17. A yarn tangling device according to claim 16 wherein said device consists of said first member and said second member.

18. A yarn tangling device according to claim 16 wherein the threaded coupling portion of said first member is threadably engaged within the threaded coupling portion of said second member, the further sealing surface of said second member being arranged within said second member between the threaded coupling portion of said second member and said chamfered portion of said further bore means arranged in said second member, and said air inlet supply means being provided in said second member, said air inlet supply means comprising a bore provided in the body portion of said second member having a centerline that is arranged at an angle with respect to a centerline of the further longitudinally extending bore means arranged in said second member, and extending to the chamber for accommodating yarn when said first and second members are secured together.

19. A yarn tangling device according to claim 16 wherein the further sealing surface surrounding the chamfered portion of said further bore means arranged in said second member is provided by a thread release portion located between said threaded coupling portion of said second member and said chamfered enlarged portion of said further bore means.

* * * * *